US007572081B2

(12) United States Patent
Buschmann

(10) Patent No.: US 7,572,081 B2
(45) Date of Patent: Aug. 11, 2009

(54) PAVING CONVOY

(75) Inventor: Martin Buschmann, Neustadt (DE)

(73) Assignee: Joseph Voegele AG, Mannheim (DE)

( * ) Notice: Subject to any disclaimer, the term of this patent is extended or adjusted under 35 U.S.C. 154(b) by 6 days.

(21) Appl. No.: 11/689,388

(22) Filed: Mar. 21, 2007

(65) Prior Publication Data

US 2007/0231069 A1 Oct. 4, 2007

(30) Foreign Application Priority Data

Mar. 24, 2006 (EP) ..... 06006162

(51) Int. Cl.
*E01C 19/21* (2006.01)
*E01C 19/08* (2006.01)

(52) U.S. Cl. ..... 404/111; 404/101; 404/104; 404/110

(58) Field of Classification Search ..... 404/111, 404/110, 101, 104, 108
See application file for complete search history.

(56) References Cited

U.S. PATENT DOCUMENTS 1,137,077 A * 4/1915 Nichols ..... 239/11
2,053,709 A * 9/1936 Flynn ..... 404/75
3,647,096 A * 3/1972 Holland ..... 414/528
3,771,893 A * 11/1973 Miller ..... 404/101
3,820,914 A * 6/1974 Zimmerman ..... 404/110
4,011,023 A * 3/1977 Cutler ..... 404/77
4,062,559 A * 12/1977 Peters ..... 280/460.1
4,196,827 A * 4/1980 Leafdale ..... 222/146.2
4,226,552 A * 10/1980 Moench ..... 404/92
4,300,853 A * 11/1981 Jones ..... 404/92
4,311,408 A * 1/1982 Wren ..... 404/104
4,390,304 A * 6/1983 Jacobson et al. ..... 404/110
4,534,674 A * 8/1985 Cutler ..... 404/75
4,780,022 A * 10/1988 Ohiba et al. ..... 404/90
4,828,429 A * 5/1989 Kirchner et al. ..... 404/111
4,944,632 A * 7/1990 Dillingham ..... 404/111
5,006,012 A * 4/1991 Sterner ..... 404/107
5,035,534 A * 7/1991 Brock et al. ..... 404/81
5,073,063 A * 12/1991 Brown ..... 404/101
5,125,764 A * 6/1992 Veath, Sr. ..... 404/108
5,131,788 A * 7/1992 Hulicsko ..... 404/108
5,219,450 A * 6/1993 Thurk ..... 404/92
5,279,500 A * 1/1994 Perrin et al. ..... 404/75
5,354,145 A * 10/1994 Sterner ..... 404/75
5,439,313 A * 8/1995 Blaha et al. ..... 404/75

(Continued)

FOREIGN PATENT DOCUMENTS

DE 297 15 467 10/1997

(Continued)

*Primary Examiner*—Raymond W Addie
(74) *Attorney, Agent, or Firm*—Darby & Darby P.C.

(57) ABSTRACT

A paving convoy for producing a bituminous cover layer including a self-propelled road paver and a paving material feeding assembly which is self-propelled and travels in front of the road paver. A paving material conveying device extends from the feeding assembly to the road paver. A spraying module including its own undercarriage and components for storing and deploying bitumen emulsion is provided between the feeding assembly and the road paver. The spraying module has a spraying bar facing the front end of the road paver. The spraying module is either coupled to the feeder assembly by a detachable towing connection or to the road paver by detachable pulling connection.

6 Claims, 1 Drawing Sheet

U.S. PATENT DOCUMENTS

| | | | | |
|---|---|---|---|---|
| 5,735,634 | A * | 4/1998 | Ulrich et al. | 404/102 |
| 5,846,022 | A * | 12/1998 | Grundl | 404/101 |
| 5,879,104 | A * | 3/1999 | Ulrich | 404/102 |
| 5,895,173 | A * | 4/1999 | O'Brien et al. | 404/108 |
| 5,957,621 | A * | 9/1999 | Clark et al. | 404/111 |
| 6,079,901 | A * | 6/2000 | Banks et al. | 404/108 |
| 6,203,243 | B1 * | 3/2001 | Birtchet | 404/104 |
| 6,514,007 | B2 * | 2/2003 | Richter | 404/75 |
| 6,619,882 | B2 * | 9/2003 | Harvey | 404/107 |
| 6,776,557 | B2 * | 8/2004 | Barnat et al. | 404/101 |
| 6,805,516 | B2 * | 10/2004 | Barnat et al. | 404/101 |
| 6,966,725 | B2 * | 11/2005 | Cochran | 404/85 |
| 7,033,106 | B2 * | 4/2006 | Harvey | 404/107 |
| 7,104,724 | B2 * | 9/2006 | Terry | 404/110 |
| 7,160,056 | B1 * | 1/2007 | Hoffmann et al. | 404/109 |
| 2001/0051073 | A1 * | 12/2001 | Richter | 404/75 |
| 2003/0012601 | A1 * | 1/2003 | Barnat et al. | 404/111 |

FOREIGN PATENT DOCUMENTS

| | | |
|---|---|---|
| EP | 0 292 337 | 11/1988 |
| FR | 2 697 546 | 5/1994 |
| JP | 2002 322603 | 11/2002 |

* cited by examiner

PAVING CONVOY

FIELD OF THE INVENTION

The invention relates to a paving convoy according to the preamble of claim 1.

BACKGROUND OF THE INVENTION

The spraying module of the paving convoy known from JP 2002 322603A is a modified standard truck on which spraying module components are arranged on the bed of the chassis. A spraying bar faces the planum operating behind the rear end of the chassis. The truck has its own traction drive and travels between the road paver travelling behind the feeding assembly travelling ahead. The feeding assembly is supplied from the trucks delivering the paving material.

In the paving convoy known from AT-E-556344 B the spraying device is integrated into the feeding assembly which in turn is constituted by a shuttle buggy. The feeding assembly conveys paving material over the spraying bar of the spraying device to the road paver. The spraying bar sprays a bitumen emulsion within the working width of the paving screed on the planum but leaves the travelling lane of the undercarriage of the paver free. The paver has spraying bars behind the undercarriage for spraying bitumen emulsion in front of the lateral distribution device of the paver on the travelling lanes only. The shuttle buggy with integrated spraying device as well as the road paver with the integrated spraying bars both have individual special designs and are for these reasons structurally complicated and costly. In cases where no bitumen emulsion is needed, the feeder has to tow the unnecessary ballast of the spraying device, and as well spraying bars on the road paver are unnecessary ballast. The spraying device and the spraying bars on the road paver are contaminated during normal paving work and for this reason need complicated cleaning work after the termination of the work, irrespective of whether the work was carried out with or without spraying bitumen emulsion.

The road paver known from U.S. Pat. No. 5,279,500 A is equipped with a fully integrated spraying device including components needed for storage and deployment of the binding agent. The spraying bar comprises nozzles which cooperated with cyclically actuated closing elements for metering the sprayed bitumen emulsion. The spraying bar can be pivoted about an axis which extends laterally to the paving travelling direction and is designed to spray oval or rectangular spots on the planum.

DE 39 42 469 A discloses an assembly for metering and deploying a liquid binding agent, in particular, bitumen, on a road surface. The assembly is arranged on a mobile chassis and comprises components for storage and deployment purposes including a spraying bar. Metering is carried out by measuring the sprayed amount according to the principle of a mass through flow measurement and simultaneous measurement of the Coriolis force. This known assembly is used in an old-fashioned manner, namely to first spray the planum during a separate spraying cycle before a paving layer is cast later on after solidification of the binding material.

In recent times paving convoys have proven superior versatility which allows to continuously cast at least one paving layer with optimally high speed, since the casting process is not interfered with by the intermittent delivery and supply of the paving material. This concept is based on the fact that the road paver is supplied with the paving material with the help of a feeding assembly or shuttle buggy travelling ahead which in turn is supplied with a lot of paving material from intermittently shuttling trucks and, so to speak, constitutes a buffer store having a huge paving material storage volume. Although the technology of deploying a bitumen emulsion serving as the binder layer for the cast on paving layer has been improved such that the bitumen emulsion is spread first immediately before casting the paving layer (EP 049 260 B), which even is practised with the paving convoy of AT-E-556344 B, until now either a special shuttle buggy with an integrated spraying system and a special road paver with integrated spraying bars for the travelling lanes only have been widely used, or a standard shuttle buggy and a special road paver having an integrated complete spraying device (DE 41 01 417 B). Since, however, companies which have to cast paving layers with or without a binding layer have to live with the unnecessary ballast of the special machines or the significantly higher costs, in case of paving work without deploying a binding layer, but in some cases also have to carry out paving work with a binding layer, there is significant demand for a paving convoy concept comprising a standard shuttle buggy and a standard road paver but nevertheless offering the selective option to also produce a binding layer in a simple and fair cost way. This would be extremely desirable in order to improve the machine capacity utilisation and to expand the application spectrum without unnecessary ballast or unnecessary supplementary cleaning work, and, in particular, with a reduction of the basic cost for the machines.

BRIEF DESCRIPTION OF THE INVENTION

It is an object of the invention to provide a paving convoy as mentioned above which is a modularly constructed system with standard machines for carrying out paving work with and without a bitumen emulsion binding layer and which allows the reduction of basic costs.

For paving work needing a binding layer, the spraying nozzle is installed between the feeding assembly, e.g. constituted by a standard shuttle buggy, and the standard road paver for deploying the bitumen emulsion binder layer in front of the road paver on the planum. Neither the standard shuttle buggy nor the standard road paver then need complicated retrofit work. In the case that a binder layer is not needed, the spraying module is dispensed with and paving work is carried out conventionally. The spraying module as a modular component of the paving convoy is a fair cost, versatile and efficient supplementary machine. Between the spraying module which does not have its own traction drive and the shuttle buggy is either provided with a towing connection which can be detached to remove the spraying module, the towing connection forcing the spraying module to travel with the shuttle buggy, or a pushing connection is provided between the spraying module which does not have its own traction drive and the road paver such that the road paver pushes the spraying module on the undercarriage with a predetermined distance in-between.

In an expedient embodiment the spraying module has its own traction drive such that the spraying module can travel between the standard shuttle buggy and the standard road paver and is adapted to at least substantially fulfil the spraying function in autarkic fashion.

In a further expedient embodiment a power transmission connection and a control signal transmission connection is provided between the spraying module and the shuttle buggy and/or the standard road paver such that the spraying module is supplied with power from one of the machines or from both machines, e.g. used for heating and deploying and metering the bitumen emulsion, or is controlled accordingly. This is a particularly fair cost embodiment of the spraying module.

Control systems and power systems provided at the shuttle buggy and/or at the road paver can fulfil such supplementary tasks needed for the operation of the then installed spraying module without problems.

Expediently a control assembly is provided which synchronously adapts the spraying width of the spraying module to the working width of the paving screed. For this purpose e.g. the mentioned power transmission connection and/or the control signal transmission connection may be used.

In a further embodiment the spraying module is situated below the conveying device feeding the paving material from the shuttle buggy to the road paver such that the transport of paving material is not interfered with by the presence of the spraying module. Preferably, the spraying module has a height lower than the height of a cantilevered supporting frame of the conveying device of the shuttle buggy such that, so to speak, the spraying module may overlap the shuttle buggy while travelling in paving travelling direction.

Finally, it is expedient when the road paver has at least one spraying bar behind the undercarriage for spraying bitumen emulsion on the travelling lanes of the undercarriage only, the spraying bar being arranged detachably and being supplied and controlled from the spraying module. This spraying bar, expediently two spraying bars, has a concept such that it can easily be mounted to and detached from the standard road paver. The supply and/or the control are then carried out from the spraying module via a line or a hose duct. If no binder layer is to be deployed, the spraying bar does not need to be mounted to the road paver, and the already installed spraying bar simply is removed and put aside or is transported on the standard road paver or the standard shuttle buggy in order to avoid a spraying bar cleaning cycle after the paving work.

BRIEF DESCRIPTION OF THE DRAWINGS

An embodiment of the invention is explained with the help of the drawing which shows a schematic side view of a paving convoy in FIG. 1.

DETAILED DESCRIPTION OF THE INVENTION

Figure 1:
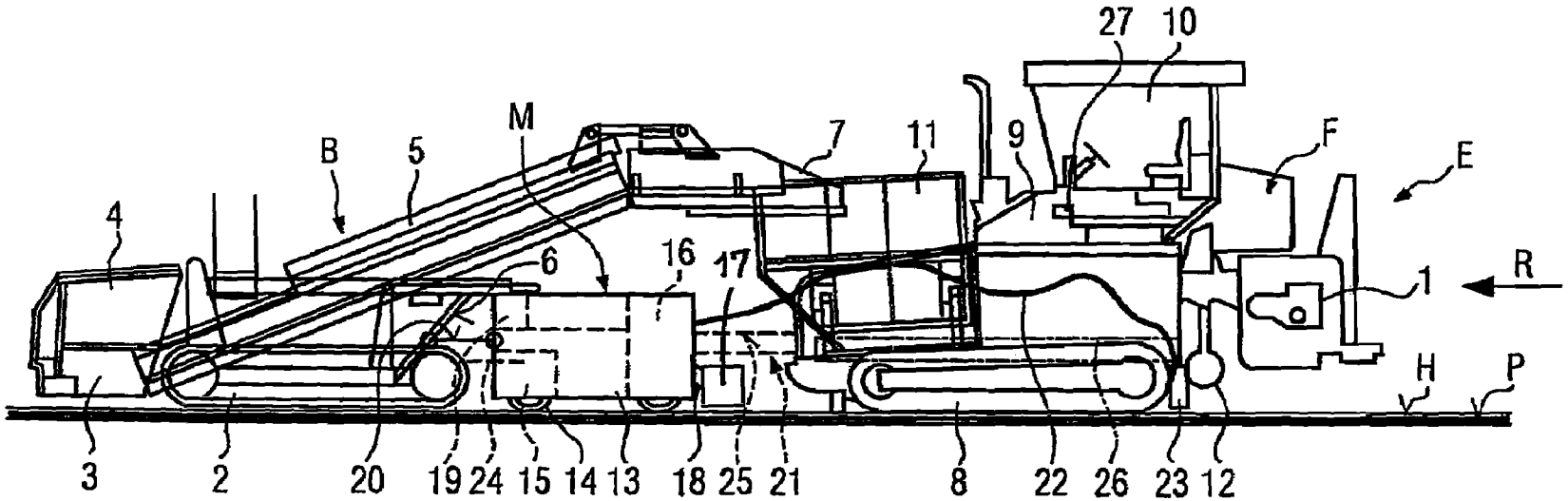

The paving convey E shown in FIG. 1 in a schematic side view serves to cast on a planum P either a bituminous cover layer (as shown) on a bitumen emulsion binder layer H, or to cast at least one, e.g. bituminous, cover layer without a binder layer H directly on the planum P (the latter case is not shown, but will explained further on).

The paving convey E comprises a standard road paver F having a towed paving screed 1 (in some cases an extendible paving screed with controlled variable working width) for casting the cover layer, e.g. of bituminous paving material, in a casting travelling direction R, and a paving material feeding assembly B travelling in front of the standard road paver F on the planum. The feeding assembly B is a so-called standard shuttle buggy. Finally, a spraying module M is provided for deploying part of the binder layer H which spraying module M is travelling on the plenum P between the feeding assembly and the standard road paver F.

The feeding assembly has an undercarriage 2, e.g. a crawler track, a chassis 3 and a chassis front end material hopper 4 filled with paving material from intermittently shuttling trucks (not shown). An obliquely ascending conveyor 5 extends from the material hopper 4 through the intermediate space between the feeding assembly B and the standard road paver F to a material hopper 11 of the standard road paver. An e.g. tiltable pouring end 7 constitutes the end portion of the conveyor 5. The conveyor, expediently, is adjustably installed on a supporting frame 6. The rear end of the supporting frame 6 cantilevers freely to the rear side of the feeding assembly B.

The standard road paver F has an undercarriage 8, e.g. a crawler track, and travels by two travelling lanes on the planum P. The standard road paver F has a primary drive source 9, e.g. a diesel engine, an operator platform 10 and a conveying system 26 extending from the material hopper 11 to the rear end of the chassis of the standard road paver F for conveying and throwing paving material in front of a lateral distribution device 12 on the planum P or the binder layer H, respectively.

The spraying module M has a chassis 13 which travels on the planum P on its own undercarriage 14.

The spraying module M contains components 16 necessary for storing, deploying and metering the bitumen emulsion with the help of a spraying bar 17 provided at the spraying module M in front of the front end of the standard road paver F. The height position of the spraying bar 17 may be adjustable. In some cases, the spraying bar 17 may even be moved cyclically by means of a linking system 18. Not shown spraying nozzles are provided at the spraying bar 17, the spraying width of which is adjustable. The spraying nozzles within the same working width as is given by the adjustment of the paving screed 1 of the standard road paver F, except the two travelling lanes of the undercarriage 8 of the standard road paver F.

Power transmission connections 24 and/or control signal transmission connections 25 may be installed from the standard shuttle buggy B and/or from the standard road paver F to the spraying module M in order to supply the spraying module M with power and/or control signals, respectively. A common working width control assembly 27 on the standard road paver F is expedient in order to synchronously adapt the spraying width of the spraying module M to the working width of the paving screed 1, e.g. via the connection 25.

As the spraying module M does not have a traction drive, either a towing connection 20 is installed between the spraying module M and the feeding assembly B, or a pushing connection 21 between the standard road paver F and the spraying module M. The towing connection 20 or the pushing connection 21 may be easily detached in order to allow removal of the spraying module M. The towing connection 20 e.g. may be detachably linked to the supporting frame 6 of the feeding assembly B.

One spraying bar or two spraying bars 23 are detachably mounted on the standard road paver F, in particular, between the undercarriage 8 and the lateral distribution device 12 in order to spray bitumen emulsion behind the undercarriage 8 on the travelling lanes, since the spraying module M does not spray the planum P in the travelling lanes of the undercarriage 8 of the standard road paver F. The spraying bar 23 or the spraying bars 23, respectively, may be supplied and/or controlled via a removable supply line 22 from the spraying module M.

In an expedient embodiment the spraying module M has a height, at least in the front side end region, which allows the spraying module M to travel below the cantilevered end of the supporting frame 6 and maintain a larger distance to the front end of the standard road paver F than to the feeding assembly B.

A distance control device and/or speed control device may be provided (not shown) which assures that the feeding assembly B and the standard road paver F travel with the same speeds and predetermined distances from one another.

During a casting travelling motion of the paving convoy E paving material is transferred from the material hopper 4 by the conveying device 5 into the material hopper 11. The paving material then is thrown on the planum P by the conveyor 26 in front of the lateral distribution device 12. The lateral distribution device 12 spreads out the paving material for the paving screed 1 which then casts the covering layer and, in some cases, even compacts the cast cover layer. The spraying module M deploys the bitumen emulsion and produces a binder layer H on the planum P, such that the two travelling lanes first are sprayed by the spraying bars 23 in front of the falling paving material.

When casting a cover layer without the binder layer H the spraying module M is removed. Expediently, also the spraying bars 23 are removed. For this purpose either the towing connection 20 or the pushing connection 21 is released, respectively, before the spraying module M either is pushed away or is towed away.

The invention claimed is:

1. Paving convoy for producing a bituminous cover layer on a planum, comprising:

a self-propelled road paver having an undercarriage and at least one paving screed for producing the bituminous cover layer from paving material;

a self-propelled paving material feeding assembly in front of the road paver for supplying the road paver with paving material, said paving material feeding assembly being at a distance to a front end of said road paver;

a paving material conveying device extending from said paving material feeding assembly within said distance to said road paver;

a spraying device including the components for storing and deploying a bitumen emulsion on said planum as a bitumen emulsion binder layer for the bituminous cover layer, said spraying device being a spraying module having its own undercarriage for traveling on the planum below said material conveying device within said distance and between said paving material feeding assembly and said front end of said road paver, said spraying module having a height lower than the height at which said conveying device extends over said distance from said paving material feeding assembly to said road paver, said spraying module deploying the bitumen emulsion between said material feeding assembly and said road paver, said spraying module being structurally separated from said paving material feeding assembly and said road paver and having a spraying bar attached to said spraying module and facing said front end of said road paver, and one of either a detachable towing connection provided between said spraying module and said paving material feeding assembly or a detachable pushing connection provided between said road paver and said spraying module.

2. Paving convoy according to claim 1, further comprising:

a power transmission connection and/or a control signal transmission connection between said spraying module and either said paving material feeding assembly and/or said road paver.

3. Paving convoy according to claim 1, wherein a working width of said paving screed is adjustable, and wherein a control device is provided for synchronously adapting the spraying width of the spraying module to the working width of the paving screed.

4. Paving convoy according to claim 1, wherein the components of said spraying device for deploying said bitumen emulsion on said planum behind traveling lines of said undercarriage of said road paver has at least one additional spraying bar is detachably arranged at said road paver behind said undercarriage, said additional spraying bar being supplied and controlled from said spraying module.

5. Paving convoy according to claim 1 further comprising at least one spraying bar for deploying bitumen emulsion on the traveling lanes of the road paver is detachably arranged at the road paver behind the undercarriage, the spraying bar being supplied and controlled from the spraying module.

6. Paving convoy according to claim 1 further comprising at least one spraying bar for deploying bitumen emulsion on the traveling lanes of the road paver that is detachably arranged at the road paver behind the undercarriage, the spraying bar being supplied and controlled from the spraying module.

* * * * *